United States Patent [19]

Iwata et al.

[11] Patent Number: 4,560,623

[45] Date of Patent: Dec. 24, 1985

[54] SPECULAR PRODUCT OF BRONZE-LIKE TONE

[75] Inventors: Yoshitaka Iwata, Zama; Ken Matsuda, Tokyo, both of Japan

[73] Assignee: Mitsubishi Chemical Industries, Ltd., Tokyo, Japan

[21] Appl. No.: 608,121

[22] Filed: May 8, 1984

[30] Foreign Application Priority Data

May 13, 1983 [JP] Japan ..... 58-83715

[51] Int. Cl.[4] ..... B32B 15/08

[52] U.S. Cl. ..... 428/626; 204/14.1; 428/648; 428/668; 428/680

[58] Field of Search ..... 428/626, 648, 668, 680

[56] References Cited

U.S. PATENT DOCUMENTS 4,042,752 8/1977 Hage ..... 428/626

OTHER PUBLICATIONS

Kirk-Othmer, Encyclopedia of Chemical Technology, 3rd Ed., vol. 6, John Wiley & Sons, N.Y., pp. 535-541, 1979.

Modern Electroplating, Ed. Frederick A. Lowenheim, The Electrochem. Soc., 3rd Ed., John Wiley & Sons, N.Y., p. 533, 1974.

*Primary Examiner*—Veronica O'Keefe

*Attorney, Agent, or Firm*—Oblon, Fisher, Spivak, McClelland & Maier

[57] ABSTRACT

A specular product of bronze-like tone particularly suitable for use as a decorative material. The specular product uses, as a substrate, a composite board comprising a synthetic resin sheet and metal sheets laminated thereon, and includes a nickel deposit plated on the metal sheet and a specular film of Sn-Ni alloy electroplated on the nickel deposit using a specific electroplating bath.

14 Claims, No Drawings

SPECULAR PRODUCT OF BRONZE-LIKE TONE

TECHNICAL FIELD

This invention relates in general to a specular product having bronze-like tone and metallic luster. More particularly, the invention concerns such a product using a lamination of synthetic resin and metals as a base material or substrate and suitable for use as a decorative material.

BACKGROUND ART

Various kinds of electroplating bathes which are adapted to provide a deposition film of Sn-Ni alloy have been known in the art, for example, the electroplating bath disclosed in Japanese Patent Application Laid-Open Publication No. 67190/1982. In general, a Sn-Ni alloy deposition film is relatively hard and has excellent corrosion and wear resistance. Nevertheless, it is less appealing in decorative value when it is used as a building material and the like, because of its undesirable color, as like a tawdry white tone having a rose-pink or stainless steel-like tint.

In view of the above disadvantages, one of the inventors has been concerned in development an electroplating bath adapted to provide Sn-Ni alloy deposit of bronze-like tone suitable for decorative applications.

DISCLOSURE OF THE INVENTION

This invention is to provide a specular product of bronze-like tone which is prepared by electroplating Sn-Ni alloy on a primary coat plated on a specific base material or substrate utilizing the plating bath adapted to provide Sn-Ni alloy deposit of bronze-like tone described above. The specular product thus prepared exhibits a good specular reflection property and is light in weight, hard to be damaged and excellent in anti-dew condensation property, workability, corrosion and wear resistance.

In addition, the specular product according to the present invention is highly useful for decorative applications, because it has deep calm and authentic tone as compared with specular product which is prepared by chrome plating on a surface of metal sheets laminated on both surfaces of a synthetic resin sheet disclosed in Japanese Patent Examined Publication No. 60601/1982.

In accordance with present invention, there is provided a specular product of bronze-like tone comprising a composite board including a synthetic resin sheet and metal sheets laminated on both surfaces of the synthetic resin sheet; a nickel deposit plated on the metal sheets; and a specular film of Sn-Ni alloy electroplated on the nickel deposite wherein atomic ratio of Sn is in a range of 10–40% and the Sn-Ni alloy has the color of L*:60–70, a*:0–3 and b*:7–12 by CIE-1976 (L*, a*, b*) color space. The specular film of Sn-Ni alloy is prepared from a plating bath of 3.5–5.5 in pH essentially consisting of (a) tin chloride and/or sulfate and nickel chloride and/or sulfate, (b) monohydroxycarboxylic acid or salt thereof, and (c) electrically conductive salt.

BEST MODE FOR CARRYING OUT THE INVENTION

A specular product according to the present invention uses, as a base material or substrate, a composite board comprising a synthetic resin sheet and metal sheets laminated or bonded on both surfaces of the synthetic resin sheet.

The synthetic resin sheet of the composite board may be formed of a suitable synthetic resin, such as, for example, polyamide, polyhydroxy ether, polycarbonate, styrene, vinyl acetate or the like. However, it is preferable to use a sheet formed of polyolefin resin such as polyethylene, polypropylene, polybutylene or the like. The thickness of the synthetic resin sheet may be determined as desired depending upon desired properties of the product, however, the sheet used generally has a thickness of about 1–10 mm. The metal sheet to be laminated on each surface of the synthetic resin sheet may be formed of any of various metals such as aluminum, iron, copper, tin and the like, as long as it is adapted to allow nickel plating or electroplating of Sn-Ni alloy to be carried out thereon. Aluminum or iron is conveniently used for this purpose. The thickness of the metal sheet may be as small as, for example, about 0.05–0.5 mm.

The composite board is prepared by securely laminating the metal sheets on both surfaces of the synthetic resin sheet. The lamination may be carried out by any of conventional process known in the art. For example, it may be carried out by successively feeding synthetic resin sheet in a molten state and metal sheets to a heated pressure roller to carry out the lamination. Alternatively, it may be carried out by adhering a synthetic resin sheet onto at least one of metal sheets and then bonding the metal sheets to each other with the synthetic resin sheet being interposed therebetween. Further, such lamination may be attained by contact-bonding metal sheets onto both surfaces of a synthetic resin film sheet under heating.

A composite board comprising a polyethylene sheet and aluminum sheets bonded onto both surfaces of the polyethylene sheet is conveniently used because it is commercially available. It is possible to use a composite board having an embossing finish on a surface of metal sheets.

The specular product of the present invention is prepared by plating a nickel film or layer on the surface of at least one metal sheet of the composite board formed as described above and then subjecting the nickel layer to electroplating utilizing a Sn-Ni alloy plating bath of a specific composition to form a specular surface of bronze-like tone and metallic luster. The product is preferably prepared to render only the surface of one of the metal sheets specular and allow the surface of the other metal sheet to have a non-electroconductive coated film, such as resin coating, pigment coating and the like, applied thereon.

A pretreatment for forming the nickel layer acting as a primary coat in the present invention may be carried out utilizing any of various conventional plating process widely used in the art as long as it is suitable for nickel plating. For example, the pretreatment may be accomplished by abrading the surface of the metal sheet, subjecting it to a degreasing treatment, removing impurity remaining on the surface therefrom by washing or the like, and activating the surface or forming a film of copper, nickel, zinc or the like on the surface by substitution. Most preferably, the pretreatment is carried out in a manner to subject the surface of the metal sheet, preferably, a luster-finished aluminum sheet to a degreasing treatment, subject it to pickling, form a zinc film thereon by substitution. The pretreated substrate is then subjected to nickel plating.

The nickel plating may be carried out utilizing a conventional process known in the art so that a nickel layer may be formed on the metal sheet which has a thickness of, for example, 5–40 μm. The nickel plating may be carried out at once or several times. Preferably, it is carried out by first forming a semi-bright nickel deposit and then applying a bright nickel deposit thereon, because such plating effectively provides the finished product with an excellent specular surface. The semi-bright nickel plating is preferably carried out using a brightener, such as, for example, butynediol, lauryl alcohol sulfate or the like, whereas the bright nickel plating is preferably accomplished using a brightener, such as, for example, butyl alcohol, propargyl alcohol or the like. The other plating conditions are substantially common to both nickel platings.

The metal sheet having the nickel deposit formed thereon in the manner described above is then subjected to electroplating using a Sn-Ni alloy plating bath. The plating bath used contains tin and nickel as metal components to be electro-deposited. These metal components each are contained in the form of chloride, sulfate or a mixture thereof. In the bath, tin having a valence of 4 is preferably used, because tin having a valence of 2 is apt to be oxidized to cause the bath to be unstable. The bath generally contains tin of 5.0–40 g/l and nickel of 2.0–10 g/l. The weight ratio of tin to nickel in the bath is 1.5:1–7:1, preferably 3:1–7:1. The ratio of tin to nickel below the range described above causes a deposition of Sn-Ni alloy film to be brittle and inferior in corrosion resistance. When tin is contained in excess of the above range, the deposited film tends to have whity tone and it is difficult to provide the finished product with bronze-like tone.

The Sn-Ni alloy film thus prepared contains Sn in a range of 10–40%, preferably 25–40%, the most preferably 30–40% in atomic ratio and has a color of L*:60–70, a*:0–3 and b*:7–12 by CIE-1976 (L*, a*, b*) color space.

Monohydroxycarboxylic acid used in the invention includes monocarboxylic acid, such as, for example, glycolic acid, lactic acid, citric acid, malic acid or the like, and polycarboxylic acid. Monohydroxycarboxylic acid may be used in the form of acid. Alternatively, it may be used in the form of its salt, such as, for example, sodium salt, potassium salt, ammonium salt or the like. It is convenient that the content of monohydroxycarboxylic acid or its salt in the bath is 20–200 g/l based on its free acid. The lower content of the acid causes the deposited film to be brittle and decrease in corrosion resistance, whereas the higher content causes the film to often have whity tone. It is preferable to use a mixture of glycolic acid and citric acid. A mixture consisting of glycolic acid of 6.5–60 g/l and citric acid of 7.5–60 g/l is preferably used. Electrically conductive salt used in the present invention includes those conventionally used in a plating bath such as potassium chloride, sodium chloride, ammonium chloride, potassium sulfate, ammonium sulfate and the like. The content of such salt in the bath is conveniently 50–300 g/l. The higher content of the salt causes streak to be readily formed in the deposition film, whereas the lower content causes electrical resistance of the bath to be increased, resulting in large heat generation.

The electroplating of Sn-Ni alloy is conveniently carried out under the conditions that the bath temperature, cathode current density and pH are set at 30°–60° C., 0.2–2.0 A/dm$^2$ and 3.5–5.5, respectively. When the bath temperature is lower than the above range, the allow is ununiformly plated to generate color shading and the electrodeposition is caused to be carried out at a disadvantageously low speed. The bath temperature higher than 60° C. causes the bath to be evaporated at a high speed to render the controlling difficult. The cathode current density smaller than 0.2 A/dm$^2$ renders the electrodeposition delayed, resulting in the productivity being highly inferior. The larger cathode current density often generates partial scorching in the plated film and/or makes the deposition bad. Further, pH of the bath affects tone of the deposited film. The pH no more than 3.5 generates color shading. The pH below the range described above causes the deposited film to have white tone and it is difficult to provide the finished product with bronze-like tone. While the pH not less than 5.5 makes the deposition of the alloy inferior. Thus, it should be noted that the pH should be set in a range between 3.5 and 5.5.

In the electroplating, an insoluble electrode such as graphite, ferrite or the like may be used as an anode. Alternatively, tin or nickel metal may be used as the anode or a part thereof to automatically replenish the metal components consumed due to electrodeposition.

As can be seen from the foregoing, the specular product of the present invention can be provided with excellent bronze-like tone and metallic luster because of using the plating bath of the specific composition and also provided with excellent specular reflection properties due to the plating treatment of allowing formation of the primary film as compared with a specular product having bright white tone which is prepared using the conventional bath for plating Sn-Ni alloy. Further, the specular product of the present invention is advantageous in that it is light in weight, have good workability and is hard to be damaged at the specular surface even if bending is carried out directly on the specular surface, because the composite board comprising synthetic resin sheet and metal sheets is used as the base material.

The following example is given to further illustrate the present invention. It is to be understood, however, that the scope of the invention is not to be limited to the specific example.

EXAMPLE

A composite board (7 cm × 10 cm) was used as a base material which was prepared by bonding luster-finished aluminum sheets of 0.25 mm in thickness onto both surfaces of a polyethylene sheet having a thickness of 1.5 mm. One of the aluminum sheets was subjected to a coating treatment, and plating treatments were carried out on the other sheet in the following manner.

The surface of the aluminum sheet was first subjected to degreasing, pickling, zinc substitution utilizing the conventional process, and then semi-bright nickel plating and bright nickel plating.

Then, the base material was immersed in a bath for electroplating Sn-Ni alloy which has such a composition as shown in Table described below and subjected to electroplating for 5 minutes using a ferrite anode under the conditions that the pH, bath temperature and cathode current density were set at 4.5, 40° C. and 0.5 A/dm$^2$, respectively.

The resulting product had a uniform deposition film plated thereon containing 35% Sn in atomic ratio and having a bright specular surface of bronze-like tone of L* being 66.0, a* and b* being 9.0 by CIE 1976 (L*, a*, b*) color space. These figures are measured by a chromameter CR-100 (Minolta Camera Co., Ltd.) using a white reflective acryl mirror (L*:100, a*:0.0, b*:0.0) as standard.

The film thus prepared was then subjected to a spraying test using an aqueous neutral salt solution defined in JIS H8502 for 24 hours. There was found no change in the film.

TABLE

Composition of Electroplating Bath

| Component | Content (g/l) |
|---|---|
| $SnCl_4.nH_2O$ | 40 |
| $NiCl_2.6H_2O$ | 13 |
| Hydroxyacetic Acid | 15 |
| 2-Hydroxy-1,2,3-Propanetricarboxylic Acid | 20 |
| Ammonium Chloride | 200 |

While a preferred form of the invention has been described with a certain degree of particularity, obvious modification and variations are possible in light of the above teachings. It is therefore to be understood that within the scope of the appended claims, the invention may be practiced otherwise than as specifically described herein.

What is claimed as new and desired to be secured by Letters Patent of the United States is:

1. A specular product of bronze-like tone, consisting essentially of:
   - a composite board including a synthetic resin sheet and metal sheets laminated on both surfaces of said synthetic resin sheet;
   - a nickel layer electroplated on at least one of said metal sheets; and
   - a specular film of Sn-Ni alloy electroplated on said nickel deposit wherein the atomic ratio of Sn in said alloy is in the range of 10–40% and said Sn-Ni alloy has a color described by the parameters of L*=60–70, a*=0–3 and b*=7–12 as defined by the CIE-1976 (L*, a*, b*) color space.

2. The specular product as defined in claim 1, wherein one of said metal sheets of said composite board is provided with said nickel deposit and Sn-Ni alloy specular film formed on the surface thereof, and the remaining metal sheet is provided with a non-conductive coating layer formed on the surface thereof.

3. The specular product as defined in claim 1, wherein said synthetic resin sheet is made of polyethylene and said metal sheets are formed of aluminum.

4. The specular product as defined in claim 1, wherein said synthetic resin sheet is 1–10 mm in thickness and said metal sheets each are 0.05–0.5 mm in thickness.

5. The specular product as defined in claim 1, wherein said nickel deposit has a thickess of 5–40 μm.

6. A specular product of bronze-like tone, consisting essentially of:
   - a composite board including a synthetic resin sheet and metal sheets laminated on both surfaces of said synthetic resin sheet;
   - a nickel layer electroplated on at least one of said metal sheets;
   - a specular film of Sn-Ni alloy electroplated on said nickel deposit wherein the atomic ratio of Sn is in the range of 10–40% and said Sn-Ni alloy has a color described by the parameters of L*=60–70, a*=0–3 and b*=7–12 as defined by the CIE-1976 (L*, a*, b*) color space; and
   - said specular film of Sn-Ni alloy being prepared from an electroplating bath of a pH of 3.5–5.5 essentially consisting of (a) tin chloride and/or sulfate and nickel chloride and/or sulfate, (b) monohydroxycarboxylic acid or salt thereof, and (c) an electrically conductive salt.

7. The specular product as defined in claim 6, wherein the tin in said plating bath has a valence of 4.

8. The specular product as defined in claim 7, wherein the weight ratio of tin to nickel in said plating bath is in the range between 1.5:1 and 7:1.

9. The specular product as defined in claim 8, wherein said monohydroxycarboxylic acid or its salt is selected from the group consisting of citric acid, glycolic acid and their salts.

10. The specular product as defined in claim 9, wherein said electroplating bath contains tin of 5.0–40 g/l, nickel of 2.0–10 g/l, monohydroxycarboxylic acid of 20–200 g/l based on its free acid an electrically conductive salt of 50–200 g/l.

11. The specular product as defined in claim 1 or 6, wherein one of said metal sheets is a luster-finished aluminum sheet, said aluminum sheet being subjected to semi-bright nickel plating, bright nickel plating and said Sn-Ni alloy electroplating in order.

12. The specular product as defined in claim 1, wherein said nickel layer is electroplated on one of said metal sheets.

13. The specular product as defined in claim 1, wherein said synthetic resin sheet is selected from the group consisting essentially of polyamide, polyhydroxy ether, polycarbonate, styrene and vinyl acetate.

14. The specular product as defined in claim 1, wherein said metal sheets are selected from the group consisting essentially of aluminum, iron, copper and tin.

* * * * *